US006163940A

United States Patent [19]

VanMaanen

[11] Patent Number: 6,163,940

[45] Date of Patent: Dec. 26, 2000

[54] SHOE FRINGE CLAMP

[76] Inventor: Kevin VanMaanen, 1963 S. Xanadu Way, Aurora, Colo. 80014

[21] Appl. No.: 09/209,622

[22] Filed: Dec. 9, 1998

[51] Int. Cl.[7] ..... A41F 1/00; A43C 7/00; A44B 11/00; B65D 77/00

[52] U.S. Cl. ..... 24/543; 24/30.5 P; 24/712.1

[58] Field of Search ..... 24/543, 487, 30.5 P, 24/712, 712.1, 129 D, 270

[56] References Cited

U.S. PATENT DOCUMENTS

| | | | |
|---|---|---|---|
| 3,828,403 | 8/1974 | Perrin et al. | 24/270 |
| 4,775,121 | 10/1988 | Carty | 24/543 |
| 4,817,944 | 4/1989 | Anderson et al. | 24/129 D |
| 5,050,272 | 9/1991 | Robinson et al. | 24/543 |
| 5,123,146 | 6/1992 | Olson | 24/30.5 P |
| 5,226,892 | 7/1993 | Boswell | 24/543 |
| 5,423,831 | 6/1995 | Nates | 24/543 |
| 5,428,871 | 7/1995 | Iosif | 24/30.5 P |
| 5,467,537 | 11/1995 | Aveni et al. | 24/712.1 |

*Primary Examiner*—Victor N. Sakran
*Attorney, Agent, or Firm*—Goldstein & Canino

[57] ABSTRACT

A shoe fringe clamp comprising a top arm, a bottom arm, a joint that allows the top arm to extend upward away from the bottom arm, and a clasp assembly that secures a smaller extension extending from the top arm to a hollow bottom extension extending from the bottom arm. Rubber strips are positioned along the inner surfaces of the top arm and bottom arm. While in the open position, the bottom arm of the shoe fringe clamp is placed under a layer of fringes found on the top portion of a shoe and the top arm is descended onto the bottom arm, thus fastening the clasp assembly. The fringes are then secured between the top arm and the bottom arm. The rubber strips protect the material of the fringes from damage.

5 Claims, 2 Drawing Sheets

SHOE FRINGE CLAMP

BACKGROUND OF THE INVENTION

The invention relates to a shoe fringe clamp. More particularly, the invention relates to a shoe fringe clamp that is attached to a layer of a plurality of fringes found on dress shoes.

Often times, shoes have a layer of fringes that extends across the top portion thereof. The layer of fringes is attached to the shoe at a point closest to the opening of the shoe; therefore, the remainder of the layer is unattached and simply rests along the front of the shoe.

When the shoes are put away, it is often possible that the shoes are not placed directly on their soles. Thus, the positioning of the shoe usually causes the layer of fringe, or a portion of the fringes, to fall away from the front of the shoe and bend or curl in an opposite direction. When the shoes are taken out to wear again, the frayed fringes give a sloppy appearance.

Once the fringe on a shoe is deformed, it is practically impossible to fix the layer, or portion of the layer, to once again fall directly on the front of the shoe. Furthermore, many people will choose not to wear the shoes again because of the disheveled appearance they will lend to one's whole ensemble.

Many people choose to place a rubber band around the layer of fringe in order to keep it in place while the shoes are not in use. While the rubber band may prevent the fringe from falling away from the front of the shoe, the fringe is often pulled together into the middle of the shoe instead of laying flat across the shoe. This creates a whole new problem.

While these units may be suitable for the particular purpose employed, or for general use, they would not be as suitable for the purposes of the present invention as disclosed hereafter.

SUMMARY OF THE INVENTION

It is an object of the invention to produce a shoe fringe clamp that is attached to a layer of fringe found on the front of dress shoes.

It is another object of the invention to produce a shoe fringe clamp that, when placed around a layer of fringe, prevents the fringe, or a portion of the fringe, from bending or curling out of position.

It is a further object of the invention to produce a shoe fringe clamp that extends around the entire length of the layer of fringe without pulling the fringe towards the middle of the top portion of the shoe.

It is a still further object of the invention to produce a shoe fringe clamp that is designed not to damage the material from which the fringe is made.

The invention is a shoe fringe clamp comprising a top arm, a bottom arm, a joint that allows the top arm to extend upward away from the bottom arm, and a clasp assembly that secures a smaller extension extending from the top arm to a hollow bottom extension extending from the bottom arm. Rubber strips are positioned along the inner surfaces of the top arm and bottom arm. While in the open position, the bottom arm of the shoe fringe clamp is placed under a layer of fringes found on the top portion of a shoe and the top arm is descended onto the bottom arm, thus fastening the clasp assembly. The fringes are then secured between the top arm and the bottom arm. The rubber strips protect the material of the fringes from damage.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
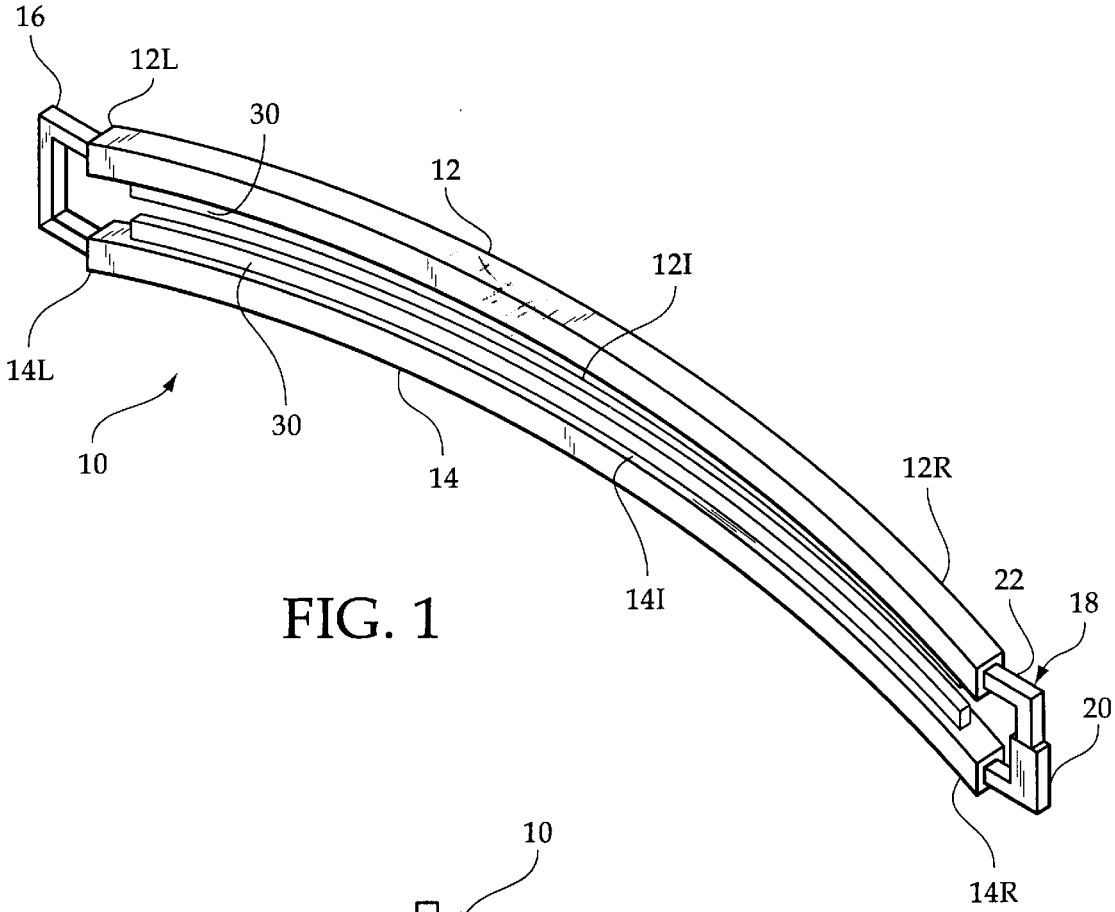
FIG. 1 is a diagrammatic perspective view of a shoe fringe clamp.

FIG. 1 illustrates a diagrammatic perspective view of a shoe fringe clamp 10. The shoe fringe clamp 10 comprises a top arm 12, having a top inner surface 12I, a top left end 12L and a top right end 12R, and a bottom arm 14, having a bottom inner surface 14I, a bottom left end 14L and a bottom right end 14R, said arms 12 and 14 being of the same length and extending parallel to each other. The top left end 12L and the bottom left end 14L are joined together by a U-shaped joint 16 and the top right end 12R and the bottom right end 14R are joined opposite therefrom by a clasp assembly 18. The clasp assembly 18 comprises an L-shaped hollow bottom extension 20 that extends from the bottom arm 14. An L-shaped smaller extension 22 projects from the top arm 12. When the top arm 12 is lowered towards the bottom arm 14, the smaller extension 22 fits into the hollow bottom extension 20, thus fastening the clasp assembly 18.

Figure 2:
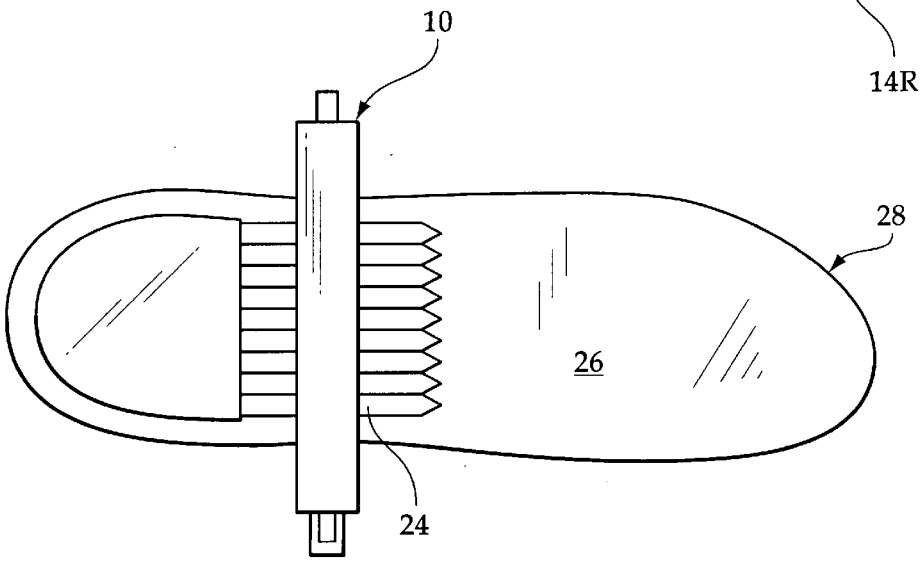
FIG. 2 is a top view of the shoe fringe clamp attached to a layer of fringe on a shoe.
Figure 3:
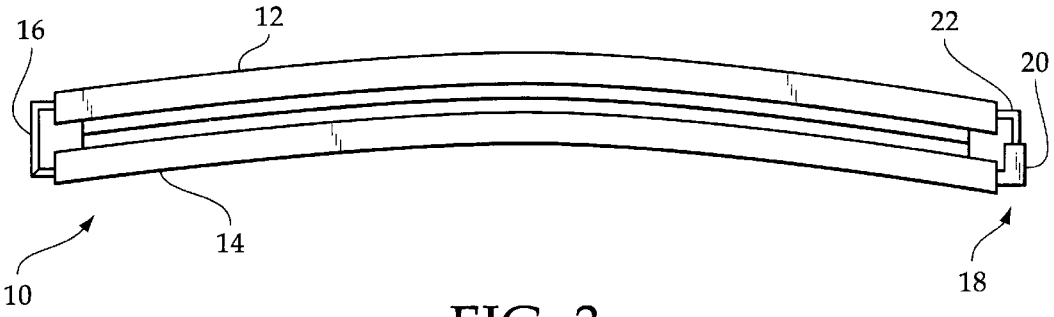
FIG. 3 is a side view of the shoe fringe clamp in the closed position.

A thin rubber strip 30 extends lengthwise along a substantial portion of the top inner surface 12I and the bottom inner surface 14I. FIG. 2 illustrates the shoe fringe clamp 10 in place on a layer of fringes 24 found on a top portion 26 of a shoe 28. When positioned over the layer of fringes 24, the rubber strips 30 hold the fringes 24 in place without damaging said fringes 24.

Figure 4:
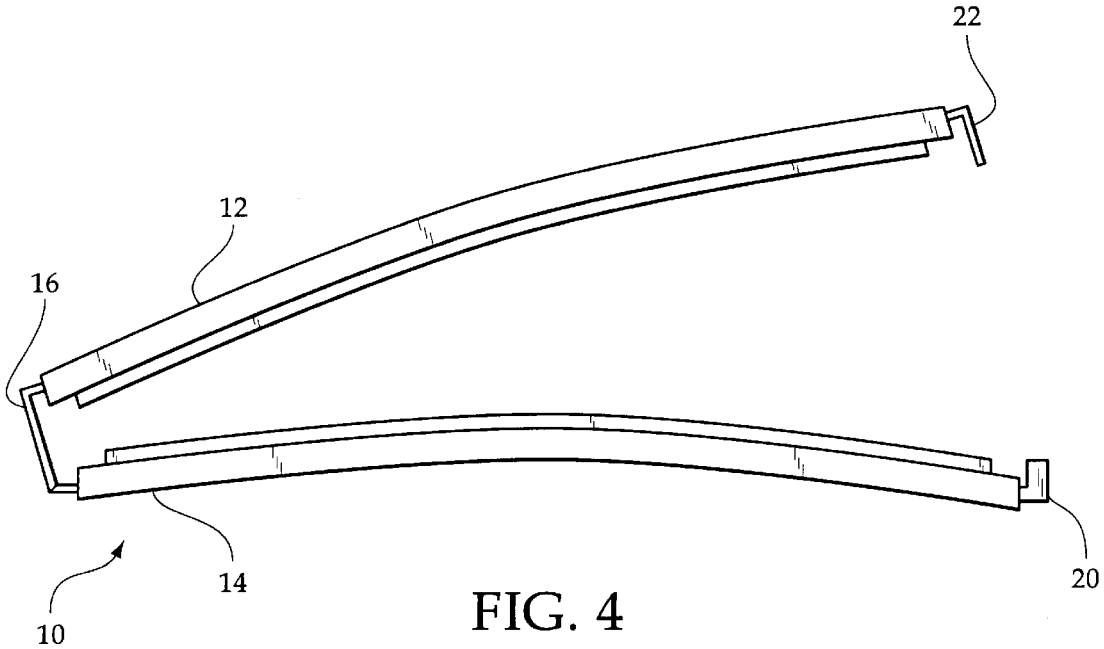
FIG. 4 is a side view of the shoe fringe clamp in the open position.

As seen in FIG. 4, the joint 16 allows the top arm 12 to extend upward at approximately a forty-five degree angle, away from the bottom arm 14. Thus, when applying the shoe fringe clamp 10 to a layer of fringes 24, said shoe fringe clamp 10 is initially in an open position. The bottom arm 14 is placed under the layer of fringes 24 and the top arm 12 is descended upon the fringes 24. The smaller extension 22 is then slid into the hollow bottom extension 20, thus securing the shoe fringe clamp 10 to the layer of fringe 24. The shoe 28 may then be put away for storage until further use without fear of damaging the fringes 24. The shoe fringe clamp 10, when employed, will keep the fringes 24 on the shoe 20 in a set position, thereby preventing the fringes 24 from curling or bending away from the shoe 28.

What is claimed is:

1. A shoe fringe clamp, for attaching to a layer of fringes found on a top portion of a shoe for preventing said fringes from curling and fraying, comprising:

a top arm and a bottom arm being of the same length and extending parallel to each other;

a U-shaped joint, said U-shaped joint connecting the top arm to the bottom arm, thereby allowing the top arm to extend upward, away from the bottom arm;

each of said arms having inner surfaces facing each other; and a clasp assembly comprising an L-shaped smaller extension extending from an end of the top arm and an L-shaped hollow bottom extension extending from an end of the bottom arm, wherein the free end of the smaller extension fits into the free end of the hollow bottom extension, thus fastening the clasp assembly;

wherein, said shoe fringe clamp further having rubber strips extending lengthwise along said inner surfaces of both the top arm and the bottom arm for holding the fringes in place without damaging said fringes.

2. A shoe fringe clamp, for attaching to a layer of fringes found on a top portion of a shoe for preventing said fringes from curling and fraying, comprising:

a top arm and a bottom arm of the same length that extend parallel to each other;

a U-shaped joint connecting the top arm to the bottom arm, thereby allowing the top arm to extend upward, away from the bottom arm; each said arms having inner surfaces facing each other; and a clasp assembly comprising an L-shaped smaller extension extending from the top arm and an L-shaped hollow bottom extension extending from the bottom arm wherein the free end of the smaller extension, thus fastening said clasp assembly fits into the free end of the hollow bottom extension;

wherein, said shoe fringe clamp further having rubber strips extending lengthwise along said inner surfaces of both the top arm and the bottom arm for holding the fringes in place without damaging said fringes.

3. The shoe fringe clamp of claim 2, wherein the joint connects the top arm to the bottom arm and allows the top arm to extend upward, away from the bottom arm.

4. The shoe fringe clamp of claim 3, having a joint that allows the top arm to extend upward at approximately a forty-five degree angle.

5. A shoe fringe clamp method, for attaching to a layer of fringes on a top portion of a shoe for preventing said fringe from curling or fraying, said shoe fringe clamp having a top arm and a bottom arm, a joint and a clasp assembly comprising a smaller extension extending from the top arm and a hollow bottom extension extending from the bottom arm, comprising the steps of:

placing the shoe fringe clamp in the open position so that the top arm is extended upward away from the bottom arm;

placing the bottom arm under the layer of fringes while the shoe fringe clamp is in the open position;

descending the top arm down, towards the bottom arm, onto the layer of fringes; and fitting the smaller extension into the hollow bottom extension, thus fastening the clasp assembly.

* * * * *